US006630639B2

(12) United States Patent
McSwiggen

(10) Patent No.: US 6,630,639 B2
(45) Date of Patent: Oct. 7, 2003

(54) PORT SWITCH AS FOR A HEARING AID DEVICE

(76) Inventor: John P. McSwiggen, 289 Byron Ave., Bloomingdale, IL (US) 60108

( * ) Notice: Subject to any disclaimer, the term of this patent is extended or adjusted under 35 U.S.C. 154(b) by 34 days.

(21) Appl. No.: 09/809,128

(22) Filed: Mar. 15, 2001

(65) Prior Publication Data

US 2003/0057068 A1 Mar. 27, 2003

Related U.S. Application Data

(60) Provisional application No. 60/189,602, filed on Mar. 15, 2000.

(51) Int. Cl.[7] ..... H01H 9/00
(52) U.S. Cl. ..... 200/52 R; 200/530; 381/324
(58) Field of Search ..... 200/530, 534, 200/345, 52 R, 314, 308; 381/324, 328

(56) References Cited

U.S. PATENT DOCUMENTS

| | | | | |
|---|---|---|---|---|
| 3,626,171 A | * | 12/1971 | Abramowitz et al. | 200/314 |
| 4,550,227 A | * | 10/1985 | Topholm | 381/324 |
| 4,758,699 A | * | 7/1988 | Ciriscioli | 200/530 |
| 4,803,458 A | | 2/1989 | Trine et al. | |
| 4,871,890 A | * | 10/1989 | Herrera | 200/314 |
| 5,559,892 A | | 9/1996 | Boor | |
| 5,692,060 A | | 11/1997 | Wickstrom | |
| 5,740,261 A | | 4/1998 | Loeppert et al. | |
| 5,861,779 A | | 1/1999 | Loeppert et al. | |
| 6,091,831 A | * | 7/2000 | Cho | 200/7 |

FOREIGN PATENT DOCUMENTS

| | | |
|---|---|---|
| DE | 34 06 971 A | 8/1985 |
| DE | 39 30 009 A | 3/1991 |

* cited by examiner

*Primary Examiner*—Renee Luebke
(74) *Attorney, Agent, or Firm*—Marshall, Gestein & Borun LLP

(57) ABSTRACT

A switch that can be installed within an aperture in a housing of an electronic device without obstructing the aperture via a port through the switch. In a particular application, the switch can be utilized in connection with a port of a microphone in a hearing aid. The switch is capable of being installed within an aperture in a faceplate of a hearing aid. The switch comprises a base having an aperture therein and two base electrical contacts, and an actuator having an aperture therein and an actuator electrical contact. The actuator is adapted to cooperate with the base to permit movement of the actuator to an open switch position and a closed switch position, wherein the actuator contact makes contact with the base contacts when the actuator is in the closed switch position. The apertures of the actuator and the base provide a generally unobstructed port through the switch in communication with the port of the microphone so that the switch can be disposed over the microphone port in a faceplate of a hearing aid device instead of occupying additional area of the faceplate, thereby saving space within the hearing aid device.

18 Claims, 3 Drawing Sheets

PORT SWITCH AS FOR A HEARING AID DEVICE

RELATED APPLICATIONS

This application claims priority to Provisional Application Serial No. 60/189,602, filed Mar. 15, 2000.

TECHNICAL FIELD

The present invention generally relates to electromechanical switches for microelectronic devices, and more particularly to a port switch for use in hearing aids having a microphone.

BACKGROUND OF THE INVENTION

State of the art hearing aids are so small that they can fit entirely within the human ear, or ear canal. These ultra-miniature hearing aids are made from even smaller components, such as a battery power supply, amplifier, microphone, receiver, and one or more electromechanical switches. In light of the size constraints, emphasis has been placed upon the miniaturization of electronics packaging for components, as well as the reduction of space requirements within the hearing aid device to accommodate such components. This trend has emphasized the importance of providing smaller-sized components and miniaturized hearing aid packages without sacrificing various features or functionality provided by these components. In particular, electromechanical switches have become extremely important to provide user control of various features and functions of the hearing aid. These switches have become difficult to incorporate in these miniature-sized devices.

The present invention is provided to solve these and other problems.

SUMMARY OF THE INVENTION

A switch that can be installed within an aperture in a housing of an electronic device without obstructing the aperture via a port through the switch. In a particular application, the switch can be utilized in connection with a port of a microphone in a hearing aid. The switch is capable of being installed within an aperture in a faceplate of a hearing aid. The switch comprises a base having an aperture therein and two base electrical contacts, and an actuator having an aperture therein and an actuator electrical contact. The actuator is adapted to cooperate with the base to permit movement of the actuator to an open switch position and a closed switch position, wherein the actuator contact makes contact with the base contacts when the actuator is in the closed switch position. The apertures of the actuator and the base provide a generally unobstructed port through the switch in communication with the port of the microphone so that the switch can be disposed over the microphone port in a faceplate of a hearing aid device instead of occupying additional area of the faceplate, thereby saving space within the hearing aid device.

DETAILED DESCRIPTION OF THE PREFERRED EMBODIMENTS

While the present invention will be described fully hereinafter with reference to the accompanying drawings, in which particular embodiments are shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1A:
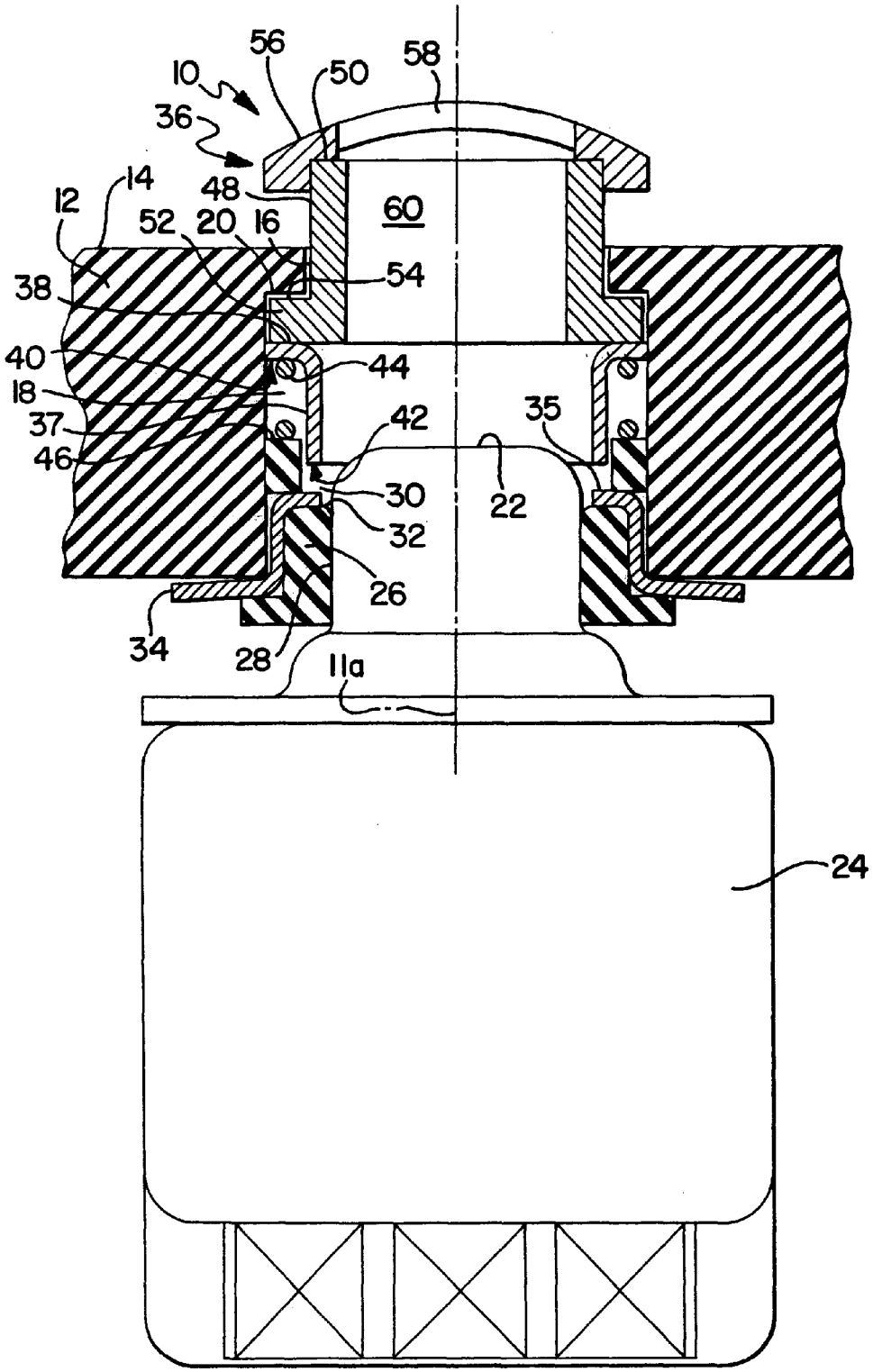
FIG. 1A is a cross-sectional side view of a first embodiment of a switch of the present invention installed into a faceplate of a hearing aid device having a microphone, the switch being depicted in a normally open position.

Referring to FIG. 1A, a first embodiment of the present invention is shown as a port switch 10 of a hearing aid device.

Figure 1B:
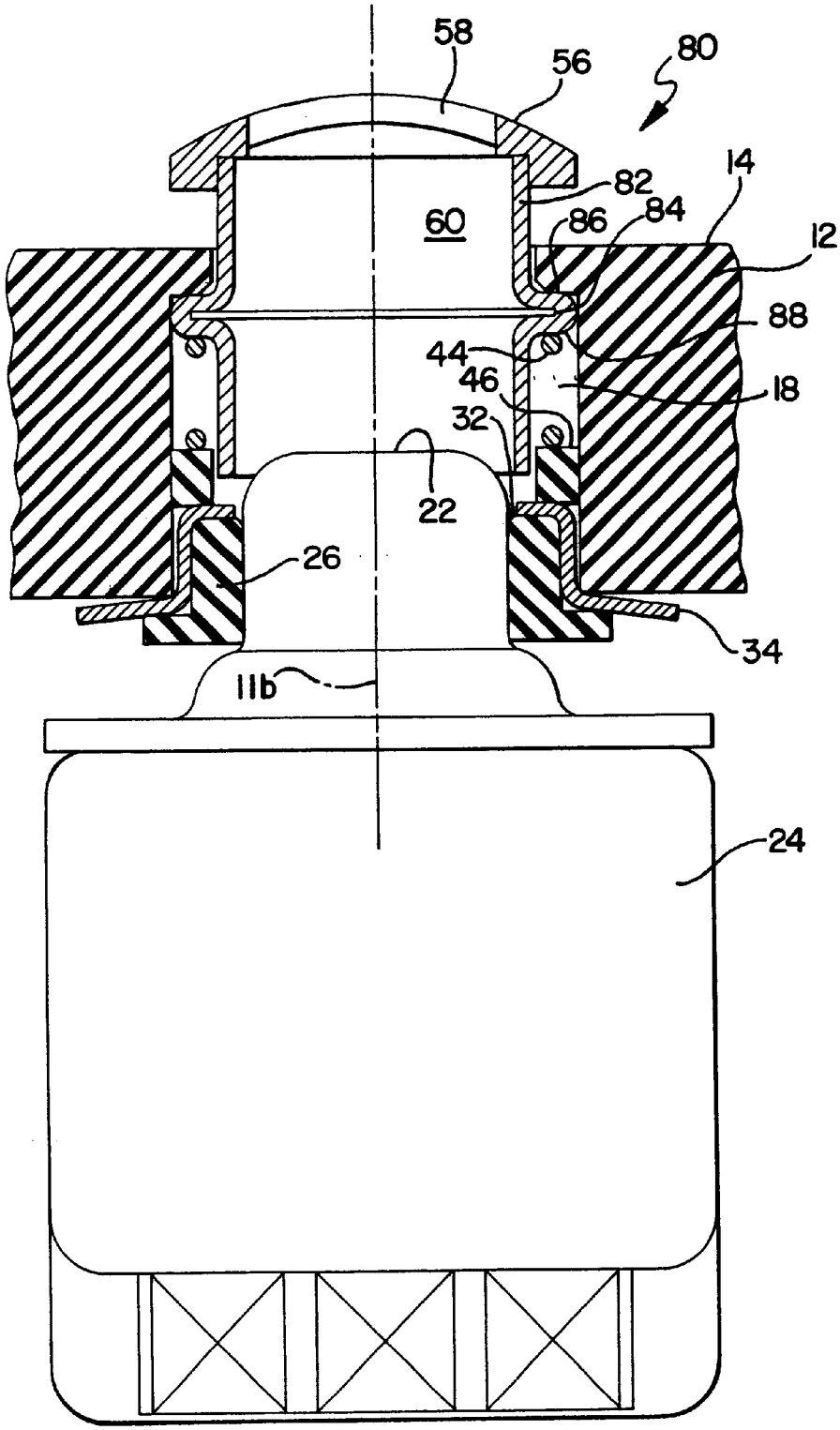
FIG. 1B is a cross-sectional side view of a second embodiment of the switch of the present invention installed into a faceplate of a hearing aid device having a microphone, the switch being depicted in a normally open position.

Referring to FIG. 1B, a second embodiment of the present invention is shown as a port switch 80 of a hearing aid device. For clarity of description, the same element numbers are used for elements that are common to both embodiments.

The port switches 10 and 80 are installed into a faceplate 12 of a hearing aid device. In a preferred embodiment, the faceplate 12 has a top surface 14 and is provided with an aperture 16 having a stepped portion, or bore portion 18. The bore portion 18 creates a bearing surface 20 within the aperture 16. The bore portion 18 is positioned over a port 22 of a microphone 24 within the hearing aid device. In an alternate embodiment, the faceplate 12 only includes the aperture 16 without the bore portion 18.

Referring to the reference numbers on the left side of the centerline 11*a* in FIG. 1A, the port switch 10 includes a base 26 having an aperture 28 that is sized to fit over the port 22 of the microphone 24 in the hearing aid device. In a preferred embodiment, a stepped portion, or bore portion 30 is provided to create a shoulder surface 32 within the aperture 28. The base 26 includes base electrical contacts 34 that are positioned within the base 26 such that ends 35 of the contacts 34 are disposed over the shoulder surface 32 within the base 26. The base 26 may be made of a[n] suitable material for electronic component housings, such as, for example, a plastic or polymeric resin. Preferably, the electrical contacts 34 are insert molded within the base 26.

The switch 10 includes an actuator 36. The actuator 36 includes an electrical contact in the form of a hollow, generally cylindrical-shaped, electrical contact sleeve 37 having a top annular shoulder surface 38, a bottom annular shoulder surface 40, and a bottom annular edge surface 42. The electrical contact sleeve 37 has a portion that is disposed within the bore portion 30 of the aperture 28 within the base 26, as shown in FIG. 1A. A spring 44 is positioned between a bearing surface 46 of the base 26 and the bottom annular shoulder surface 40 of the sleeve 37. The spring 44 biases the contact sleeve 37 such that the bottom annular edge surface 42 of the sleeve 37 does not make contact with the electrical contacts 34 within the base 26 when the switch 10 is in a normal position, as shown in FIG. 1A. In this arrangement, the switch 10 is a normally open switch. Alternatively, the switch 10 could be a normally closed switch, similar to the embodiment depicted in FIG. 2, wherein a portion of the electrical contacts are disposed above the base 26. In this type of arrangement, the sleeve 82 makes contact with the electrical contacts 122 in the normal switch position.

In the switch 10, the actuator portion 36 also includes a tube 48 having a top edge surface 50 and an annular shoulder 52 around its base. The tube 48 is disposed over the top shoulder surface 38 of the sleeve 37 and extends past the top surface 14 of the faceplate 12. Preferably, the tube 48 is made of a plastic or other polymeric material. The annular shoulder 52 of the tube creates a top annular surface 54 that provides a stop for the upward switch travel. The spring 44 biases the sleeve 37 such that the top annular surface 54 bears against the bearing surface 20 within the aperture 16 of the faceplate 12 of the hearing aid. A cap 56 having an aperture 58 therein can be disposed over the top edge surface 50 of the tube 48 to provide a push button surface for a user of the hearing aid device. Alternatively, the cap 56 can be integrally designed as part of the tube 48, thereby reducing the parts of the switch 10.

The aperture 28 in the base 26, the hollow sleeve 37 and the aperture 58 in the cap 56 are combined to form a port 60 through the switch that is in communication with the port 22 of the microphone 24 so that the switch can be disposed over the microphone port 22 in the faceplate 12 of the hearing aid device without significantly affecting the operation of the microphone 24. This configuration saves space within the hearing aid device. A screened aperture 57 (FIG. 2) may be incorporated into the cap 56 to prevent particles or other foreign matter from penetrating the port 60 of the switch 10.

Referring now to the reference numbers shown on the right side of centerline 11*b* in FIG. 1B, the switch 80 eliminates the use of the tube 48 of the port switch 10. In this embodiment, a hollow, generally cylindrical-shaped, electrical contact sleeve 82 extends past the top surface 14 of the faceplate 12. The sleeve 82 has an annular ring, or annular shoulder 84 formed therein. The annular shoulder 84 has a top surface 86 and a bottom surface 88. The top surface 86 acts as a stop for the upward switch travel. The spring 44 biases the contact sleeve 82 such that the top surface 86 of the shoulder 84 bears against the bearing surface 20 within the bore portion of the aperture 16 of the faceplate 12 of the hearing aid. The bottom surface 88 of the shoulder 84 bears against the spring 44. The switch 80 is shown in a normally open position, wherein the sleeve 37 does not make contact with the electrical contacts 34 within the base 26 when the switch 10 is in a normal position, i.e., when no force is applied to the actuator 36 to overcome the biasing force of the spring 44. This embodiment eliminates the tube 48 of the first embodiment port switch 10. This reduces the cost of the switch in terms of materials as well as fabrication.

Figure 2:
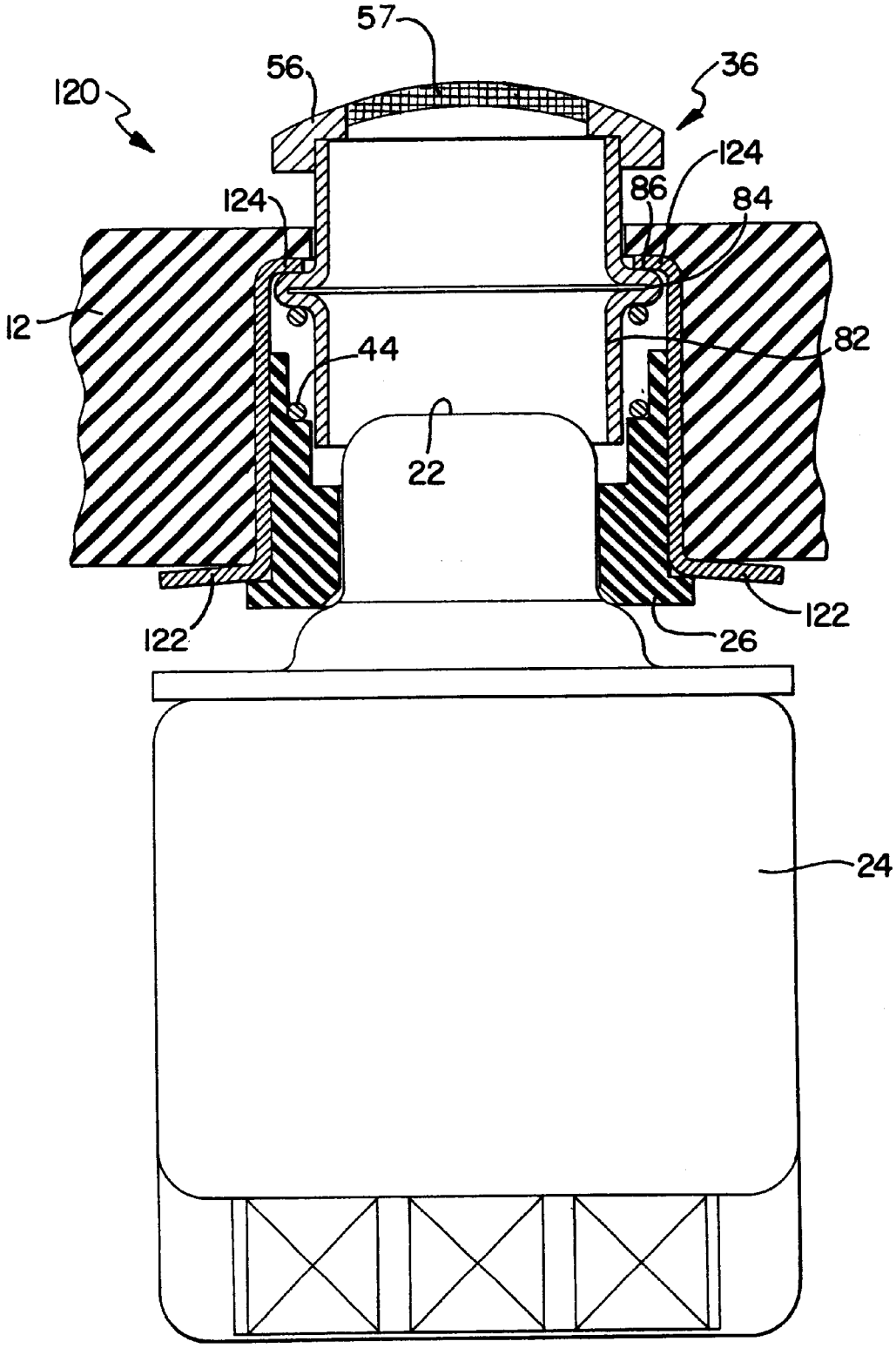
FIG. 2 is a cross-sectional side view of the second embodiment depicted in FIG. 1B wherein the switch is in a normally closed position.

FIG. 2 shows an embodiment in the form of a switch 120, which is in a normally closed position. In this embodiment, a pair of elongated base electrical contacts 122 are connected to the base 26 and each include a portion 124 that extends above the base 26, as shown in FIG. 2. The portion 124 is positioned such that the annular shoulder 84 of the contact sleeve 82 makes contact with the portions 124 when the spring 44 biases the contact sleeve 82 in a normally closed position. Thus, when the actuator 36 is depressed by a user, the spring 44 compresses and the portions 124 of the electrical contacts 122 and the top surface 86 of the annular shoulder 84 separate to form an open position.

While the specific embodiments have been illustrated and de-scribed, numerous modifications may come to mind without significantly departing from the spirit of the invention, and the scope of protection is only limited by the scope of the accompanying claims.

What is claimed is:

1. A switch adapted to be installed within an aperture in a housing of an electrical device, the switch comprising:

a base having an aperture therein and two base electrical contacts; and an actuator having an aperture therein and an actuator electrical contact, the actuator adapted to cooperate with the base to permit movement of the actuator to an open switch position and a closed switch position, the actuator contact making contact with the base contacts when the actuator is in the closed switch position;

the apertures of the actuator and the base providing a generally unobstructed port through the switch, wherein the actuator includes a spring in contact with the base that biases the actuator in a normally open position, and wherein the base electrical contacts each have a portion disposed within the aperture of the base and are capable of making contact with the actuator electrical contact.

2. The switch of claim 1, wherein the actuator electrical contact includes a generally cylindrically-shaped contact sleeve having two ends, one of the ends disposed within the aperture of the base.

3. The switch of claim 2, wherein one of the ends of the contact sleeve is capable of making contact with the base electrical contacts.

4. The switch of claim 3, wherein the actuator includes a tube that bears against the other end of the contact sleeve, the tube having a portion that extends outwardly from an outer surface of the device.

5. The switch of claim 3, wherein a portion of the contact sleeve extends outwardly from an outer surface of the device.

6. A switch for use in connection with a port of a microphone disposed adjacent to an aperture of a hearing aid device, the switch comprising:

a base having an aperture therein and two base electrical contacts, at least a portion of the base being sized to fit within the aperture of the hearing aid device; and an actuator having an aperture therein and an actuator electrical contact, the actuator having a portion disposed within the aperture of the base and being moveable with respect to the base, the actuator capable of being moved to an open switch position and a closed switch position, the actuator contact making contact with the base contacts when the actuator is in the closed switch position, wherein the actuator includes a cap connected to one end of the actuator, the cap having an aperture therein and wherein the cap includes a screen across the aperture in the cap;

wherein the apertures of the actuator and the base providing a generally unobstructed port through the switch in communication with the port of the microphone.

7. The switch of claim 6, wherein the actuator includes a spring in contact with the base that biases the actuator in a normally open position.

8. The switch of claim 7, wherein the actuator includes a shoulder portion, the spring bearing against the shoulder portion and urging the actuator away from the base electrical contacts.

9. The switch of claim 6, wherein the actuator includes a spring in contact with the base to bias the actuator in a normally closed position.

10. The switch of claim 9, wherein the actuator includes a shoulder portion, the spring bearing against the shoulder portion and urging the actuator toward a portion of the base electrical contacts that are disposed above the base.

11. The switch of claim 6, wherein the actuator includes a generally cylindrically-shaped contact sleeve having a shoulder portion and a spring, and wherein the base includes a bearing surface, the spring bearing against the shoulder portion of the contact sleeve and the bearing surface of the base to urge the sleeve away from the base.

12. The switch of claim 11, wherein the switch is in the normally open position when the contact sleeve is urged away from the base.

13. The switch of claim 11, wherein the switch is in the normally closed position when the contact sleeve is urged away from the base.

14. A switch for use in connection with a port of a microphone disposed adjacent to an aperture in a faceplate of a hearing aid device, the switch comprising:

a base having an aperture therethrough, the base including a spring bearing surface and two base electrical contacts, at least a portion of the base being sized to fit within the aperture in the faceplate and at least a portion of the base aperture being sized to accept the port of the microphone; and an actuator having an aperture therethrough and one end disposed within the aperture of the base, the actuator including a spring and an actuator electrical contact, the spring bearing against the spring bearing surface of the base and urging the actuator away from the base in a normal position, the actuator capable of being in an open switch position and a closed switch position, the actuator contact making contact with the base contacts when the actuator is in the closed switch position;

wherein at least a portion of the base is disposed within the aperture in the faceplate and at least a portion of the port of the microphone is disposed within the aperture of the base when the switch is installed; and wherein the apertures of the actuator and the base provide a generally unobstructed port through the switch and in communication with the port of the microphone.

15. The switch of claim 14, wherein the normal switch position is the open switch position.

16. The switch of claim 14, wherein the normal switch position is the closed switch position.

17. The switch of claim 14, wherein the actuator includes a cap connected to the other end of the actuator, the cap having an aperture therein.

18. The switch of claim 14, wherein the cap includes a screen disposed across the aperture.

* * * * *